US005326134A

United States Patent [19]

Hiser

[11] Patent Number: 5,326,134

[45] Date of Patent: Jul. 5, 1994

[54] SKI POLE LATCH

[76] Inventor: E. Bruce Hiser, 464A Snyders Lake Rd., R.D. #4, Troy, N.Y. 12180

[21] Appl. No.: 86,690

[22] Filed: Jul. 2, 1993

[51] Int. Cl.[5] ..... A63C 11/22

[52] U.S. Cl. ..... 280/822; 280/821; 24/17 AP

[58] Field of Search ..... 280/816, 819, 820, 822; 24/17 AP, 300

[56] References Cited

U.S. PATENT DOCUMENTS

| | | | |
|---|---|---|---|
| 3,995,872 | 12/1976 | Joseph | 280/822 |
| 4,172,601 | 10/1979 | Hutter . | |
| 4,234,202 | 11/1980 | Loffelholz | 280/820 |
| 4,358,138 | 11/1982 | Laughlin et al. . | |
| 4,493,494 | 1/1985 | Feagin, Jr. . | |
| 4,589,681 | 5/1986 | Erickson . | |
| 4,597,589 | 7/1986 | Fujii et al. . | |

FOREIGN PATENT DOCUMENTS

| | | | |
|---|---|---|---|
| 257435 | 10/1967 | Australia | 280/820 |
| 1283656 | 12/1961 | France | 280/822 |
| 2509620 | 1/1983 | France | 280/820 |

*Primary Examiner*—Brian L. Johnson

*Attorney, Agent, or Firm*—Schmeiser, Morelle & Watts

[57] ABSTRACT

A ski pole latch for removably securing a ski pole to a bar of the type generally found on ski lifts. Either a latch or a strap connection is utilized to allow a skier to encircle a bar of the type normally found on the ski lift so as to enable the skier to have free use of hands. The encircling feature while securing the pole to a ski lift bar is readily removed by opening the encircling device when the skier pulls on the ski pole hand grips.

3 Claims, 1 Drawing Sheet

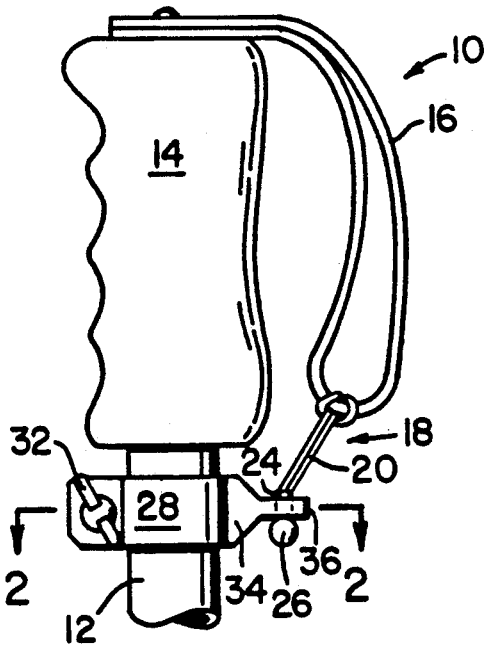
FIG. 1
FIG. 2
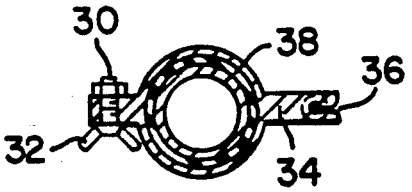
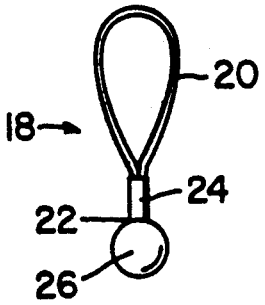
FIG. 3
FIG. 4
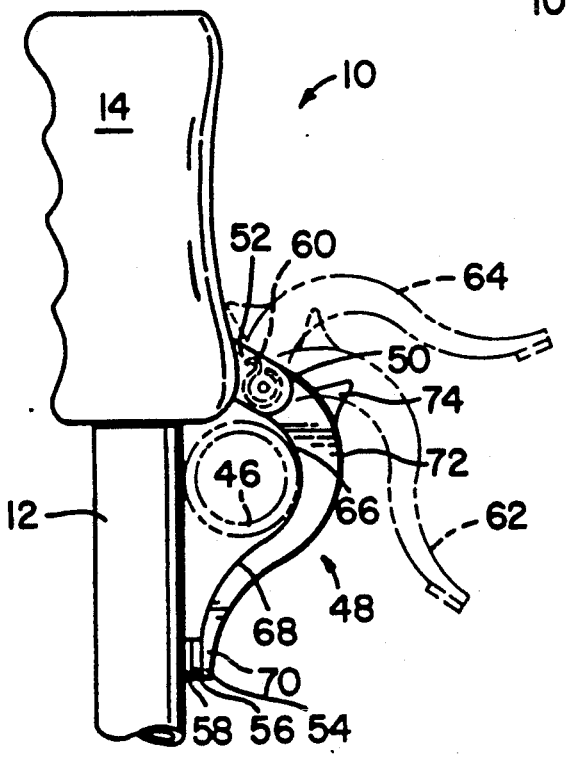
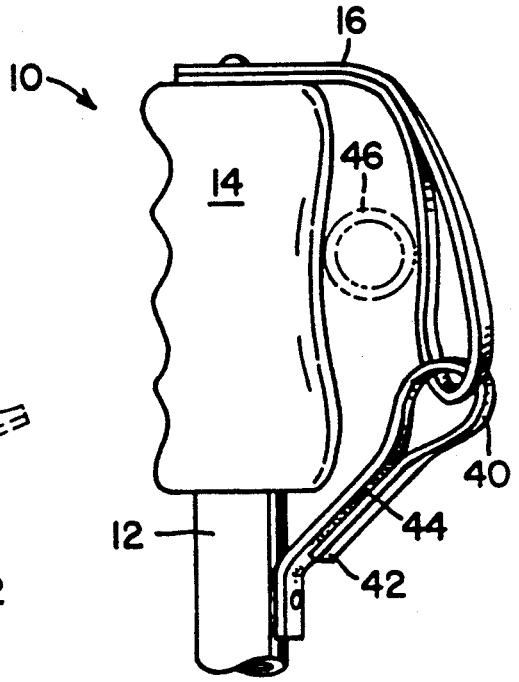
FIG. 5

SKI POLE LATCH

FIELD OF THE INVENTION

Generally, this invention relates to skiing apparatus. More specifically, the invention is directed to an improved ski pole having a latch mechanism for removably securing the ski pole to a bar of the type, often found on ski lifts.

BACKGROUND OF THE INVENTION

Downhill snow skiing is a popular sport in many parts of the world. Due to the popularity of this sport, many improvements have been made to much of the ski equipment normally used. These improvements cover items such as bindings, skis, clothing and the like. The result of many of these improvements has been to make the sport safer and easier, especially for the less experienced skier.

One of the primary difficulties in the sport of downhill skiing is the fact that by its very nature the sport is conducted in somewhat adverse weather conditions. In addition, the sport requires what is generally a rather energetic effort as one proceeds downhill, followed often by waiting lines or at least by a relatively slow trip back up the slope by means of a ski lift or the like. This trip back up the slope is of course once again followed by a downhill adventure and the process repeats itself throughout the day.

Other difficulties in this sport, involve such problems as managing somewhat burdensome skis and poles, readjusting equipment and clothing, and the more common difficulty of staying warm when going back up the hill on a ski lift.

In order to complete as many runs as possible a skier will waste little time from one run to the next. Therefore, skiers will often utilize time on the ski lift for the readjusting of equipment, clothing and the like. In addition, due to wind factors and the fact that the skier is sedentary, the skier is often much colder while on the ski lift. Thus, it becomes necessary readjust, hats, face masks, gloves and other equipment to stay warm while on the ski lift and then prepare for the next run prior dismounting.

Making these procedures more difficult is the fact that the skier is carrying ski poles which are awkward at best. These somewhat cumbersome poles cause the skier to go through numerous gyrations trying to hold the ski poles while at the same time adjusting ski equipment. In addition, gloves which may have been warm while on a downhill run are often not sufficient on the ski lift. This is especially true where the downhill run results in some overheating making the ski lift cool down even more uncomfortable. To stay warmer on the ski lift it is often preferable to put ones hands in ones pockets. This of course is at best difficult if one is trying to also hold a set of ski poles.

For these reasons it is not uncommon to have ski poles drop from ski lifts. Furthermore, since ski lifts have multiple seating it is possible to injure someone else on the ski lift as the poles are moved about in order to free up ones hands.

While some ski poles have handles or the like which could be utilized to attach the pole to the ski lift, these devices are insufficient. A significant problem in using such devices is the difficulty that is encountered when dismounting. Skiers need to be able to quickly and positively release the pole from a secured position on the ski lift without the pole becoming caught, and thus accomplish a safe dismount.

Some devices allow one to use the ski pole as a foot rest while on a ski lift. In doing so, these poles also have a lever which can lean against the ski lift. While such an approach may be beneficial in providing for a foot support, the ski pole must be continually grasped by the skier in order to maintain it in its proper position.

It was with these various difficulties in mind that I began developing the subject invention to free up the skiers hands which will allow the skier not only to do other things while on the ski lift but also makes the lift trip more comfortable.

SUMMARY OF THE INVENTION

The subject invention was developed in order to overcome the aforementioned difficulties and provide a simple yet effective product for the skier. This was accomplished by creating a bar encircling feature which utilizes either the existing ski pole straps or a separate latch mechanism.

Utilizing the former approach a ski pole may be adapted by securing a receptor to the pole shaft. The receptor is designed to receive a flaccid connector which is attached to the strap, removably joining the receptor to the ski pole strap. This combination forms a holding portion which may be secured around a bar on the ski lift or the like but can be detached by simply pulling on the pole.

This provides the skier with the ability to retrofit the ski pole so that it may be releasably attached to a ski lift bar or the like at low cost. Important to this embodiment is the fact that the connector releases quickly and easily to assure that the skier will have no difficulty when dismounting the ski lift equipment. In addition, for safety the device does not effect the normal grip or functioning of the pole.

In the latter embodiment, a latch having a curvilinear inner surface is secured to the pole and may be manufactured as a part thereof. The latch is used by snapping it over a bar on the ski lift and is especially configured to move to an open position by simply pulling on the pole.

Both of these embodiments allow the user to secure the ski poles so that the skiers hands are free while at the same time allowing for an easy and safe dismount.

BRIEF DESCRIPTION OF THE DRAWINGS

FIG. 1 is a side elevational view of the subject invention;

FIG. 2 is a top plan view taken along lines 2—2 of FIG. 1;

FIG. 3 is an elevational view taken of one of the items in the invention;

FIG. 4 is a front elevational view of an alternate embodiment; and

FIG. 5 is front elevational view of another alternate embodiment.

DETAILED DESCRIPTION OF THE DRAWINGS

FIG. 1 discloses the top half of a ski pole generally designated as 10. The ski pole consists of an elongated shaft 12 and, at the top of the elongated shaft, secured over the shaft, is a hand grip 14. On most ski poles a hand strap 16, which is generally a single strap formed in a loop to fit over a skiers wrist is secured to the hand grip, in some fashion.

According to the subject invention, a flaccid connector 18 is secured to the strap. The connector may be made of a variety of materials however, we have found that a slightly elastic material is very suitable for this purpose. The flaccid connector 18 may be tied to the strap 16 as shown in FIG. 1. More specifically, the flaccid connector 18 as shown in FIG. 3 has a first portion 20 which itself forms a loop. The first portion 20 is a unitary material, the ends of which are secured together in the second portion 22 which forms the attachment means and consists of a collar 24 and an enlarged blocking member 26.

Secured about the shaft 12 is a clamp 28 as shown in FIG. 1. The clamp 28 may be secured to the pole by means of a bolt 30 and wing nut assembly. When the wing nut is sufficiently tightened, the clamp becomes securely fastened to the pole and wing nut 32 assembly prevents the clamp from sliding. As shown in FIG. 2, the clamp 28 may include an inner pliant material 38 which further prevents slipping and allows the clamp to be secured tightly to poles of varying size. This pliant material may be any one of a number of different compositions, however, we have found that a semi-hard rubber is very suitable for this purpose. On the side of the clamp 28 which is opposite the bolt and wing nut assembly is a receptor 34 which is unitary with the clamp and forms a resilient notch 36. As shown in FIG. 1 when the collar 24 is secured within the resilient notch 36 the ski pole, strap, flaccid connector, and receptor means form an enclosure which may be fit around a bar on a ski lift.

FIG. 5 shows an alternate embodiment of this configuration wherein the flaccid connector 18 is a connector strap 40 which is secured at free end 42 to the shaft 12. The connector strap 40 includes attachment means 44 which may be made of hook and material fastener type means of the type commonly marketed under the trademark "VELCRO".

As shown, the connector strap 40 may be slipped through the loop of the hand strap 16 and secured to itself thus encircling a ski lift bar or the like generally designated as 46.

FIG. 4 discloses an alternate embodiment utilizing a latch 48. The secured end 50 of the latch 48 is rotatably mounted to a support 52 which is secured to the hand grip 14.

As shown in FIG. 4 the latch is moveable between an open and a closed position. In moving to the open position, the latch rotates more than 90° in order to assure that a ski lift bar 46 will easily disengage from the latch when the latch is open. The latch has a free end 54 which may include a first magnet 56 which will mate wit-h a second magnet or magnetic material 58 which is secured to the elongated shaft 12.

The latch 48, at its pivotal connector, includes a spring mechanism 60 which biases the latch to the closed position when the latch moves toward the closed position past a midpoint shown in phantom as 62. Conversely, the latch is biased to the open position when the latch moves beyond the midpoint 62 toward the open position as shown in phantom as 64. The latch could also be fabricated from a resilient material such as soft rubber which could be deformed to the open position when pulling on the pole and then resume the close position in its quiescent state.

An important aspect of this latch mechanism relates to the inside configuration of that portion of the latch which faces and/or is secured against the ski lift bar 46. The inside portion of the latch which is opposite the shaft 12 is generally concave. Thus, moving from the support 52 down toward the first magnet 56, describing the inner surface of the latch, it can be said that the inner latch is generally curvilinear having a first arcuate curved section 66 which forms the previous described concave area opposite the shaft. The inner portion of the latch then forms a recurve at 68 which recurve ends at a substantially asymptotical relationship with the shaft at 70.

With this configuration a skier holding the handgrip 14 can disengage from the ski lift bar 46 by simply lifting the ski pole 10. In essence, the ski lift bar serves as a wedge between the recurve section 68 and the shaft 12, moving the latch 48 in an opening direction as the pole is lifted. It should also be noted that, if necessary, the skier can disengage the latch 48 by pulling down on the pole. In this latter case, the bar 46 engages portion 48 and slides outward along inclined shoulder of recurved section 68 moving the latch 48 past the midpoint whereby the biasing will fully open the latch.

Secured on the outside surface 72 of the latch 48 is a projection 74 which aides the skier in grasping the rotatable portion of the latch and moving it to the open position.

In operation, the skier, after positioning him or herself on the ski lift opens the encircling portion of the invention by either opening the latch 48 or disengaging the flaccid connector 18 from the resilient notch 36. The user may then encircle any part of the ski lift or other area to which the ski pole is to be secured by either closing the latch 48 or locking the collar 24 into the resilient notch 36. At this point the skier need no longer hold the ski pole and may perform whatever activities are desired. When the skier is ready to disengage the poles all that needs to be done if for the skier to hold the hand grip 14 and give a slight pull on the pole which will either open the latch 48 or disengage the flaccid connector 18. It should be appreciated that in both situations an upward motion will be sufficient to disengage the ski pole, however, almost any type of pulling motion will also disengage the ski pole 10.

While the above describes the preferred embodiments of subject invention should be appreciated that many variations may be made without the parting from the substance of the invention the scope of which is intended to be limited owned by the subject claims.

I claim:

1. In an improved ski pole having an elongate shaft, a hand grip at one end of said shaft to be held by a skier and a hand strap attached to the pole, the improvement comprising:

a flaccid connector having a first portion secured to the hand strap, a second portion of said connector forming an attachment means;

a reception means secured to said pole, said reception means adapted to receive and engage said attachment means forming an enclosure bound by the ski pole, the strap, the connector and the reception means, at least one interface of the enclosure between said pole, hand strap connector and reception means being detachable for opening and closing the enclosure whereby a skier may removably secure the pole to a ski lift during use; wherein the hand strap forms a loop and a loop and said first portion of the connector extends through said loop and attaches to itself by a collar member.

2. The invention of claim 1 wherein said connector is removably secured to both said hand strap and said reception means.

3. The invention of claim 2 wherein said first portion of the connector forms a loop and said second portion has a stem secured at one end to said connector loop, the other end of said stem having an enlarged blocking member, said receptor means having a resilient notch for receiving said stem, said blocking member preventing the stem from sliding through said notch.

* * * * *